US006019631A

United States Patent [19]

Chen

[11] Patent Number: 6,019,631

[45] Date of Patent: Feb. 1, 2000

[54] STACKED ELECTRICAL CONNECTOR ASSEMBLY

[75] Inventor: Chien-Cheng Chen, Tu-Chen, Taiwan

[73] Assignee: Hon Hai Precision Ind. Co., Ltd., Taipei Hsien, Taiwan

[21] Appl. No.: 09/370,382

[22] Filed: Aug. 9, 1999

[51] Int. Cl.[7] ..... H01R 13/60

[52] U.S. Cl. ..... 439/541.5; 439/676

[58] Field of Search ..... 439/541.5, 676, 439/701, 79

[56] References Cited

U.S. PATENT DOCUMENTS

| | | | |
|---|---|---|---|
| 5,531,612 | 7/1996 | Goodall et al. | 439/676 |
| 5,562,507 | 10/1996 | Kan | 439/676 |
| 5,639,267 | 6/1997 | Loudermilk | 439/607 |
| 5,823,822 | 10/1998 | Tan et al. | 439/541.5 |

*Primary Examiner*—Gary F. Paumen
*Attorney, Agent, or Firm*—Wei Te Chung

[57] ABSTRACT

A stacked connector assembly comprises upper and lower connectors. Each of the upper and lower connectors comprises an upper or a lower housing, a corresponding upper or lower insert member received within the corresponding upper or lower housing, and a plurality of upper or lower contacts retained in the corresponding upper or lower insert member. The upper insert member and the upper contacts are substantially the same as the lower insert member and the lower contacts. The upper connector is L-shaped and defines a receiving space for engaging with the lower connector, while the lower connector forms a pair of dovetailed engaging ribs for engaging with corresponding dovetailed grooves defined in the upper connector, thereby easily engaging or disengaging the upper and lower connectors.

14 Claims, 4 Drawing Sheets

STACKED ELECTRICAL CONNECTOR ASSEMBLY

BACKGROUND OF THE INVENTION

The present invention relates to a stacked electrical connector assembly, and particularly to a modular stacked electrical connector assembly which can be easily modified to accommodate different connector requirements.

The trend today is to position more electrical connectors on a circuit board to accommodate the connection of an increasing number of peripheral devices to a computer. Taiwan Patent Application No. 85103162 describes a horizontally stacked connector assembly for mounting onto an edge of a circuit board. The horizontally stacked connector assembly comprises a plurality of mating openings horizontally aligned in an elongate housing for receiving corresponding mating connectors. The housing extends along the edge of a circuit board and is thus limited by the dimension of the edge of the circuit board, therefore, the number of mating connectors is also limited.

Another type of stacked connector assembly for efficiently using space on a circuit board is disclosed in U.S. Pat. Nos. 5,639,267; 5,531,612 and 5,562,507 and in Taiwan Patent Application Nos. 84109709 and 86207512. These stacked connector assemblies commonly comprise an elongate main housing, upper and lower rows of horizontally aligned mating openings vertically aligned in the main housing for receiving corresponding mating connectors, and a plurality of first and second insert members retaining contacts therein and being respectively received in the corresponding mating openings for engaging with the corresponding mating connectors. The upper row of mating openings is usually arranged in a mirror image of the lower row.

However, the number of the mating openings of this type of stacked connector assembly is also limited since the stacked connector assembly is commonly mounted on an edge of the circuit board and the length of the edge is limited. Moreover, since the position and the length of the stacked connector assembly is usually pre-designated on the circuit board, it is difficult to change the position and length of the stacked connector assembly to account for changes in performance required. The stacked connector assembly can only engage with the specific mating connectors included in its design thereby limiting its application. Additionally, the insert members received in the upper row of mating openings are different from the insert members received in the lower row, thereby complicating the manufacture and increasing the cost of the insert members.

BRIEF SUMMARY OF THE INVENTION

A main object of the present invention is to provide a stacked connector assembly having upper and lower connectors which can be vertically stacked together and can be easily disengaged from each other thereby facilitating exchanges of selected connectors according to practical requirements.

Another object of the present invention is to provide a stacked connector assembly having two substantially equivalent insert members for being received in corresponding upper and lower connectors thereby simplifying manufacturing procedures and decreasing costs thereof.

A stacked connector assembly in accordance with the present invention comprises upper and lower connectors. Each of the upper and lower connectors comprises an upper or a lower housing, a corresponding upper or lower insert member fixed to the corresponding upper or lower housing, and a plurality of upper or lower contacts retained in the corresponding upper or lower insert member. The upper insert members and the upper contacts are substantially the same as the lower insert members and the lower contacts. The upper connector is L-shaped and defines a receiving space for engaging with the lower connector, while the lower connector forms a pair of dove-tailed engaging ribs for engaging with corresponding dove-tailed grooves defined in the upper connector, thereby easily engaging or disengaging the upper and lower connectors.

Other objects, advantages and novel features of the invention will become more apparent from the following detailed description when taken in conjunction with the accompanying drawings.

DETAILED DESCRIPTION OF THE INVENTION

Figure 1:
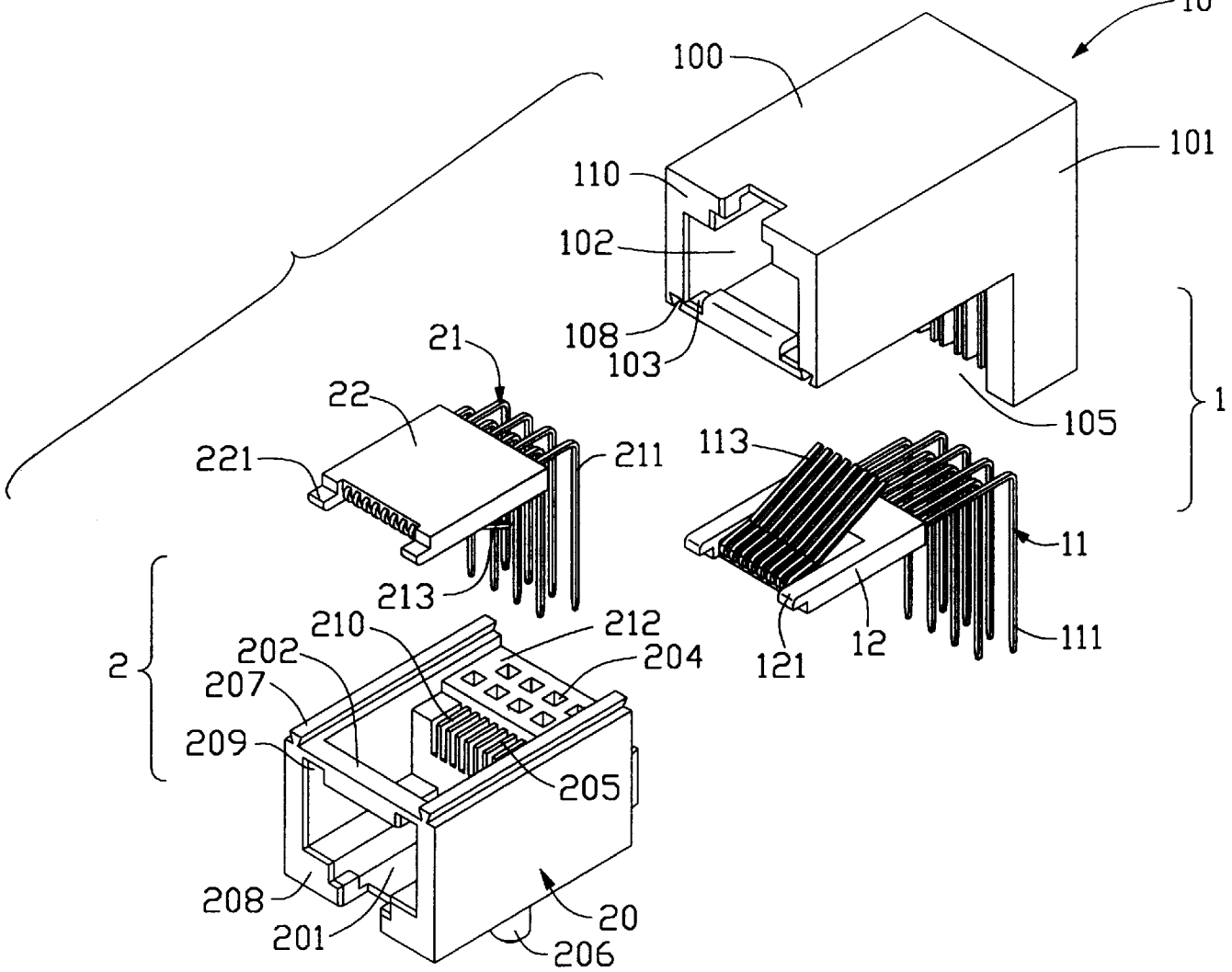
FIG. 1 is an exploded view of a stacked connector assembly in accordance with the present invention.
Figure 2:
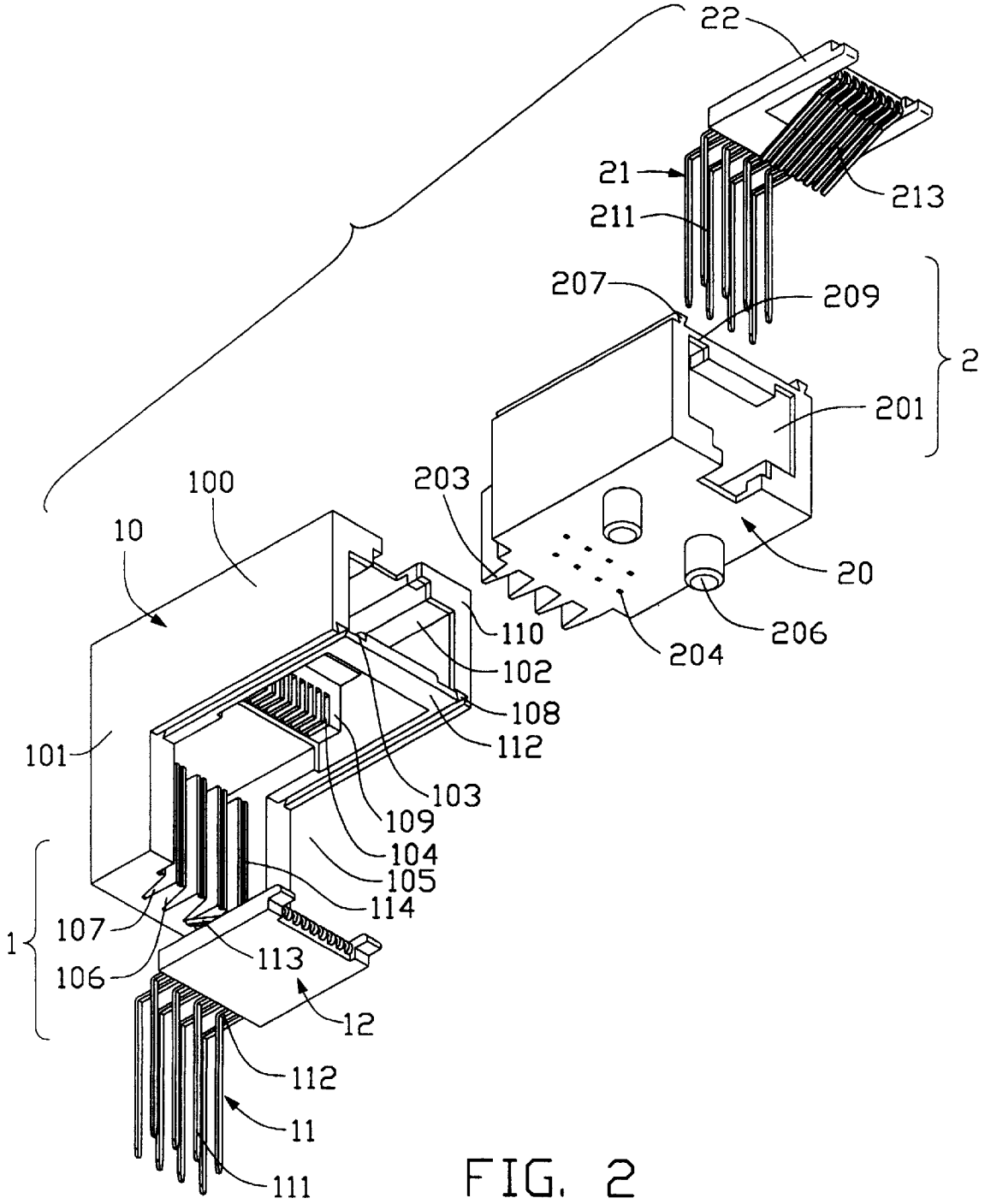
FIG. 2 is another exploded view of the stacked connector assembly.

Referring to FIGS. 1 and 2, a stacked connector assembly in accordance with the present invention comprises an upper connector 1 and a lower connector 2. The upper connector 1 comprises an L-shaped dielectric upper housing 10, a dielectric upper insert member 12 fixed to the upper housing 10, and a plurality of upper contacts 11 retained in the upper insert member 12. The lower connector 2 comprises a dielectric lower housing 20, a dielectric lower insert member 22 fixed to the lower housing 20, and a plurality of lower contacts 21 retained in the lower insert member 22.

The upper housing 10 of the first connector 1 comprises a first portion 100 and a second portion 101 perpendicularly extending from the first portion 100. A receiving space 105 is defined between the first and second portions 100, 101 for receiving the lower connector 2 therein. The first portion 100 defines an upper mating opening 102 in a front wall 110 and an upper combing section 109 inwardly extending from a rear wall thereof. A plurality of first positioning grooves 104 is defined in the combing section 109. A pair of elongate dove-tailed grooves 108 is defined in opposite sides of an outer surface of a bottom wall 112 for engaging with the lower connector 2. A pair of cutouts 103 is defined in opposite sides of a front end of the bottom wall 112 in communication with the upper mating opening 102. The second portion 101 defines a plurality of elongate positioning channels 107 separated from each other by a plurality of partitions 106. A positioning notch 114 is defined in each partition 106.

The upper insert member 12 is received in the upper mating opening 102 of the upper housing 10. A pair of upper protrusions 121 outwardly extends from opposite sides of the upper insert member 12 for engaging with the corresponding cutouts 103 of the upper housing 10.

The upper contacts 11 are insert molded with the upper insert member 12. Each upper contact 11 comprises a retaining section (not shown) received within the upper insert member 12, a curved contact section 113 extending from the upper insert member 12 and being properly bent relative to the retaining section for engaging with corresponding terminals of an upper connector (not shown), and a connecting section 111 perpendicularly extending from the retaining section opposite the contact section 113 for electrically connecting with a circuit board (not shown). The connecting section 111 of the upper contacts 11 are aligned in two rows for respectively engaging within the corresponding positioning channels 107 and the corresponding positioning notches 114 of the upper housing 10.

The lower housing 20 of the lower connector 2 defines a lower mating opening 201 in a front wall 208. The lower mating opening 201 as well as a pair of cutouts 209 is an inverted mirror image of the upper mating opening 102 of the upper housing 10. A lower combing section 205 inwardly extends from a rear wall 212 of the lower housing 20 and defines a plurality of aligned positioning grooves 210 therein. A plurality of elongate apertures 204 is defined in the rear wall 212. A plurality of projections 203 outwardly extends from the rear wall 212 for engaging with the corresponding positioning channels 107 of the upper housing 10. A pair of dove-tailed engaging ribs 207 upwardly extends from opposite sides of an upper peripheral wall 202 of the lower housing 20 for engaging with the corresponding dove-tailed grooves 108 of the upper housing 10. A pair of board locks 206 downwardly extends from a bottom surface of the lower housing 20 for connecting to the circuit board.

The lower insert member 22 is substantially the same as the upper insert member 12, thus, the upper and lower insert members 12, 22 can be formed in a single mold thereby reducing the costs thereof and simplifying the manufacturing process thereof. The lower contacts 21 are insert molded with the lower insert member 22 and are substantially the same as the upper contacts 11, except that connecting sections 211 of the lower contacts 21 are shorter in length and are bent in an opposite direction relative to corresponding curved contact sections 213 for engaging within the corresponding apertures 204 of the lower housing 20. The lower contacts 21 also comprises retaining sections (not shown) received in the lower insert member 22 and curved contact sections 213 for partially extending into the corresponding positioning grooves 210 of the lower combing section 205 of the lower housing 20. A pair of lower protrusions 221 outwardly extends from opposite sides of the lower insert member 22 which is similar to the upper protrusions 121 of the upper insert member 12.

Figure 3:
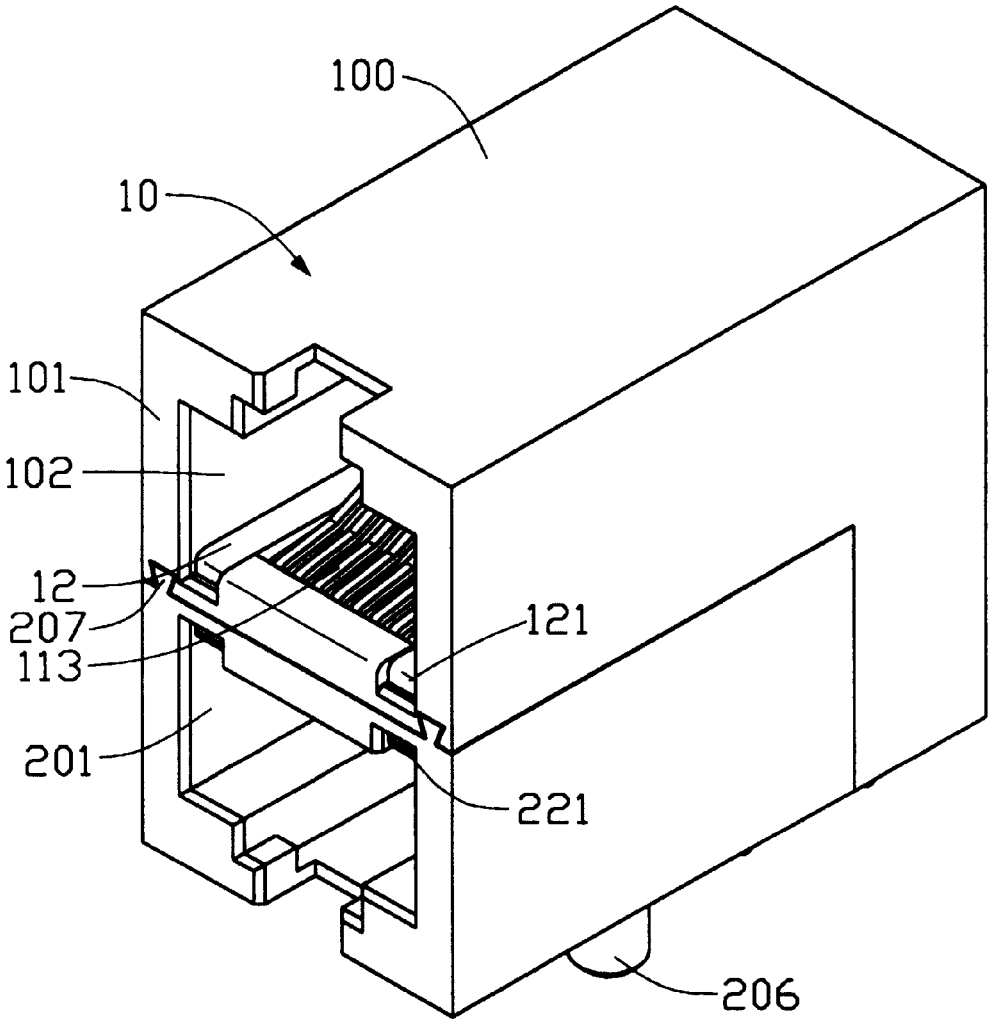
FIG. 3 is a perspective assembled view of the stacked connector assembly.
Figure 4:
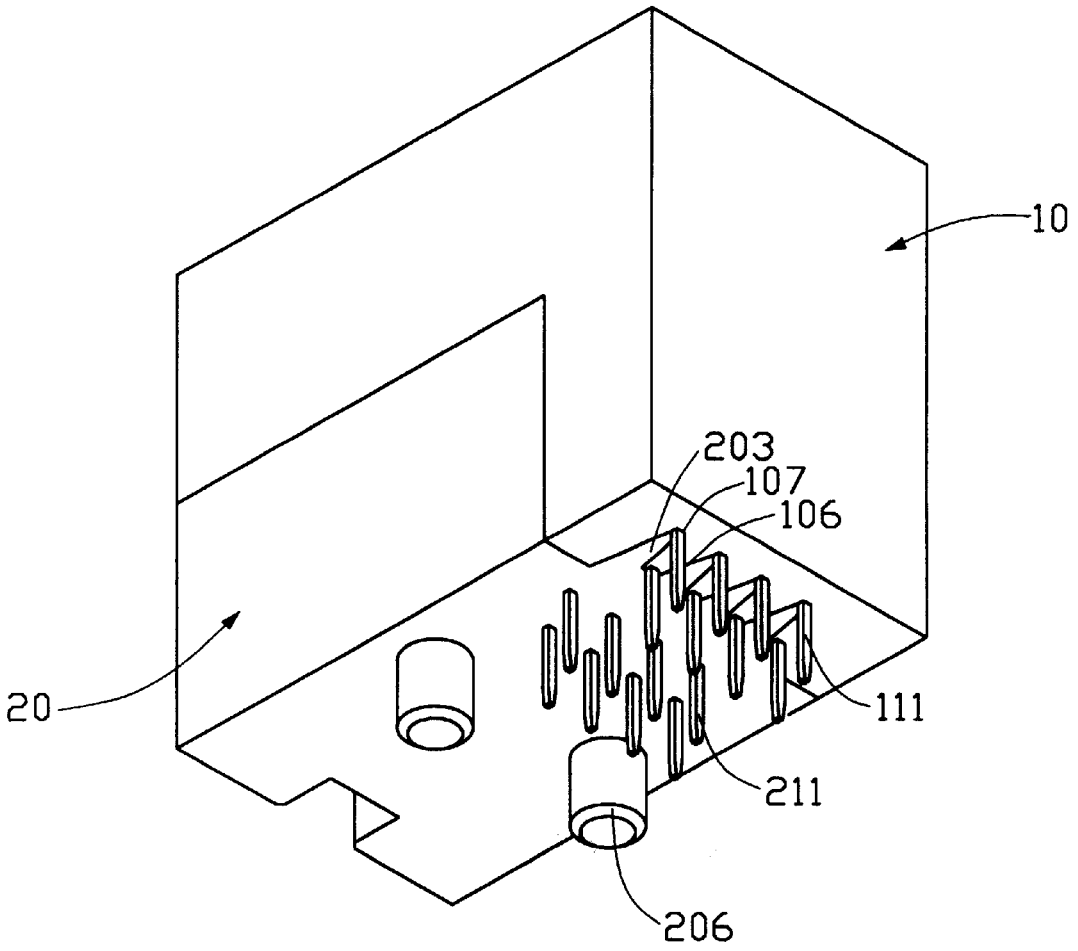
FIG. 4 is another perspective assembled view of the stacked connector assembly.

Referring to FIGS. 3 and 4, in assembly, the upper and lower insert members 12, 22 are assembled with the corresponding upper and lower housing 10, 20. The connecting sections 111 of the upper contacts 11 engage with the corresponding positioning notches 114 of the upper housing 10 and the corresponding positioning channels 107. The contact sections 113 of the upper contacts 11 partially extend into the corresponding positioning grooves 104 of the upper combing section 109. The upper protrusions 121 of the upper insert member 12 engage with the corresponding cutouts 103 of the upper housing 10. Thus, the upper connector 1 is completed. The lower connector 2 is assembled together in a similar way except that the connecting sections 211 of the lower contacts 21 engage within the corresponding apertures 204 of the lower housing 20.

The dove-tailed engaging ribs 207 of the lower connector 2 are then moved to engage with the corresponding dove-tailed grooves 108 of the upper housing 10 thereby completing the assembly of the stacked connector assembly of the present invention.

It can be noted that other than the manufacturing advantages mentioned before, in the invention the application advantages include availability of variety of the lower connector to cooperate with the upper modular jack connector, in comparison with the existing prior arts using a bracket/frame defining two rows of openings for both only receiving modular jack connectors therein.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A stacked connector assembly comprising:

an upper connector comprising a dielectric upper housing including a front wall, a first portion and a second portion, a dielectric upper insert member received in the upper housing, and a plurality of upper contacts retained in the upper insert member for electrically connecting a first mating connector with a circuit board, the first portion defining an upper mating opening in the front wall for receiving the first mating connector therein, the second portion perpendicularly extending from a rear wall of the first portion and defining a plurality of aligned positioning channels therein separated by a plurality of partitions, a pair of grooves being defined in opposite sides of a bottom wall of the upper housing, a receiving space being defined between the first and second portions and communicating with the grooves and the positioning channels; and a lower connector being positioned in the receiving space of the upper connector, and comprising a dielectric lower housing defining a lower mating opening for receiving a second mating connector, a dielectric lower insert member received in the lower housing, and a plurality of lower contacts retained in the lower insert member for electrically connecting the second mating connector with the circuit board, a pair of engaging ribs upwardly extending from opposite sides of an upper wall of the lower housing corresponding to the grooves of the upper housing and a plurality of projections outwardly extending from a rear wall of the lower housing corresponding to the positioning channels of the upper housing for engaging the lower connector with the upper connector.

2. The stacked connector assembly as claimed in claim 1, wherein the engaging ribs of the lower housing are dove-tailed, and wherein the grooves of the upper housing are also dove-tailed corresponding to the engaging ribs of the lower housing.

3. The stacked connector assembly as claimed in claim 1, wherein a pair of cutouts is defined in opposite sides of a bottom wall of the upper mating opening of the upper housing, and wherein a pair of upper protrusions outwardly extends from opposite sides of the upper insert member for engaging with corresponding cutouts of the upper housing.

4. The stacked connector assembly as claimed in claim 3, wherein the lower mating opening and a pair of cutouts of the lower housing are inverted mirror images of the upper mating opening and the cutouts of the upper housing.

5. The stacked connector assembly as claimed in claim 4, wherein a pair of lower protrusions outwardly extends from opposite sides of the lower insert member for engaging with corresponding cutouts of the lower housing.

6. The stacked connector assembly as claimed in claim 1, wherein the upper contacts are substantially the same as the lower contacts, each of the upper and lower contacts comprising a curved contact section extending into corresponding upper and lower mating openings of corresponding upper and lower housings, a retaining section received within corresponding upper and lower insert members, and a connecting section perpendicularly extending from the retaining section for electrically connecting with the circuit board.

7. The stacked connector assembly as claimed in claim 6, wherein the connecting sections of the upper and lower contacts are aligned in two rows, a first row of the connecting sections of the upper contacts engaging within corresponding positioning channels of the upper housing.

8. The stacked connector assembly as claimed in claim 7, wherein a positioning notch is defined in each partition of the second portion of the upper housing for engaging with the connecting section of corresponding upper contacts of a second row before the engaging projections of the lower housing engage with the positioning channels.

9. The stacked connector assembly as claimed in claim 6, wherein an upper combing section inwardly extends from the rear wall of the upper housing and defines a plurality of upper positioning grooves for positioning and separating the curved contact sections of the upper contacts.

10. The stacked connector assembly as claimed in claim 6, wherein a lower combing section inwardly extends from the rear wall of the lower housing and defines a plurality of lower positioning grooves for positioning and separating the curved contact sections of the lower contacts.

11. The stacked connector assembly as claimed in claim 6, wherein a plurality of apertures is defined in the rear wall of the lower housing for positioning the connecting sections of the lower contacts thereof.

12. The stacked connector assembly as claimed in claim 1, wherein the upper insert member is substantially the same as the lower insert member.

13. A housing connector assembly comprising:

an upper connector comprising an upper housing defining a first portion and second portion perpendicular to each other, said first portion defining an upper mating opening;

a receiving space formed under the first portion and beside the second portion;

an upper insert member with a plurality of upper contacts located within the upper housing, each of said upper contacts defining an upper contact section extending into the upper mating opening and an upper connecting section extending through the second portion;

a lower connector positioned within the receiving space of the upper housing, said lower connector including a lower housing defining a lower mating opening;

a lower insert member with plurality of lower contacts located within the lower housing, each of said lower contacts defining a lower contact section extending into the lower mating opening and a lower connecting section extending along a rear wall of the lower housing; and means for assembling said upper connector and said lower connector together;

wherein the upper housing defines a passage around an underside of the first portion thereof so that the upper insert member can be upwardly assembled to the upper housing with the upper contact sections of the upper contacts extending into the upper mating opening;

wherein the lower housing defines a passage around an upper side thereof so that the lower insert member can be downwardly assembled to the lower housing with the lower contact sections of the lower contacts extending into the lower mating opening.

14. The assembly as claimed in claim 13, wherein said assembly includes board locks extending downward from a bottom surface of the lower housing of the lower connector.

* * * * *